US006817921B2

(12) United States Patent
Chin et al.

(10) Patent No.: US 6,817,921 B2
(45) Date of Patent: Nov. 16, 2004

(54) ACTION FIGURE

(75) Inventors: Kwok-Tung Chin, Kowloon (CN); Chi-Wing William Ng, New Territories (CN)

(73) Assignee: M & C Toy Centre Limited, Kowloon (CN)

( * ) Notice: Subject to any disclaimer, the term of this patent is extended or adjusted under 35 U.S.C. 154(b) by 101 days.

(21) Appl. No.: 10/318,738

(22) Filed: Dec. 13, 2002

(65) Prior Publication Data

US 2004/0198154 A1 Oct. 7, 2004

(51) Int. Cl.[7] ..... A63H 3/46
(52) U.S. Cl. ..... 446/376; 446/383; 446/390
(58) Field of Search ..... 446/268, 101, 446/330, 375, 376, 378, 381, 383, 390, 382

(56) References Cited

U.S. PATENT DOCUMENTS

| | | | | | |
|---|---|---|---|---|---|
| 1,677,652 | A | * | 7/1928 | Peck | 446/376 |
| 3,974,593 | A | * | 8/1976 | Walker, Jr. | 446/73 |
| 4,274,224 | A | * | 6/1981 | Pugh et al. | 446/375 |
| 6,089,950 | A | * | 7/2000 | Lee et al. | 446/376 |
| 6,422,916 | B1 | * | 7/2002 | Enku | 446/330 |
| 6,439,952 | B1 | * | 8/2002 | Yamamura | 446/383 |

* cited by examiner

*Primary Examiner*—Derris H. Banks
*Assistant Examiner*—Bena B. Miller
(74) *Attorney, Agent, or Firm*—Alix, Yale & Ristas, LLP

(57) ABSTRACT

An action figure includes a body, limbs extending from the body and each comprising proximal and distal limb segments articulated to one another by a joint comprising two intermediate pivotally interconnected members. The first member is attached pivotally to the proximal limb segment and the second member is attached pivotally to the distal limb segment.

9 Claims, 9 Drawing Sheets

ACTION FIGURE

BACKGROUND OF THE INVENTION

The present invention relates to action figures or dolls. More particularly, although not exclusively, the invention relates to such figures or dolls having special joints between articulated limb segments.

Many action figures and dolls have their limb segments articulated by pivot pins or simple hinge joints. Such joints provide a limited range of movement of one limb segment with respect to another. It is known to use ball joints or other higher degree of freedom connections at shoulder and hip joints and these provide an increased range of possible movements of the upper limb segments with respect to the doll body.

Dolls and particularly action figures to date do not however display natural ranges of movement and this is often attributable to the fact that the limb segment-to-segment joints do not provide human-like articulation.

OBJECTS OF THE INVENTION

It is an object of the present invention to overcome or substantially ameliorate the above disadvantage and/or more generally to provide an improved doll or action figure.

It is a further object of the present invention to provide an improved upper-to-lower limb articulation joint for a doll or action figure.

DISCLOSURE OF THE INVENTION

There is disclosed herein an action figure comprising:

a body, limbs extending from the body and each comprising proximal and distal limb segments articulated to one another by a joint comprising two intermediate pivotally interconnected members, the first of which is attached pivotally to the proximal limb segment and the second of which is attached pivotally to the distal limb segment.

Such a joint will allow a 360 degree movement of the distal limb segment with respect to the proximal limb segment. That is, the knee and elbow joints of the action figure are adapted to enable a 3D movement of being distal limb segment.

Preferably one of the first or second intermediate members comprises a disc and the other of the first or second intermediate members comprises a transverse cavity receiving the disc pivotally so that the distal limb member can twist relative to the proximal limb member.

Preferably the proximal limb segment comprises a lower portion that can twist with respect to an upper portion.

Preferably one of the intermediate members has extending therefrom a cap to engage with the distal limb segment to prevent over-swinging thereof.

Preferably the joint is attached to the proximal limb segment so as to pivot about a first transverse axis.

Preferably the joint is attached to the distal limb segment such that the distal limb segment pivots about a second transverse axis.

Preferably the two intermediate members are mutually interconnected in such a manner as to allow the second transverse axis to twist with respect to the first transverse axis.

Preferably the body comprises a chest portion and a hip portion articulated to the chest portion by a midsection.

Preferably the midsection can twist with respect to thee chest portion and hip portion.

Preferably the proximal limb segment is attached to the body by a joint allowing both pivoting and twisting thereof.

DEFINITION

As used herein, the term "action figure" is intended to encompass dolls of both male or female human form having manually reconfigurable limbs, toy robots, toy animals and other toy objects having limbs, either motor driven or manually reconfigurable.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
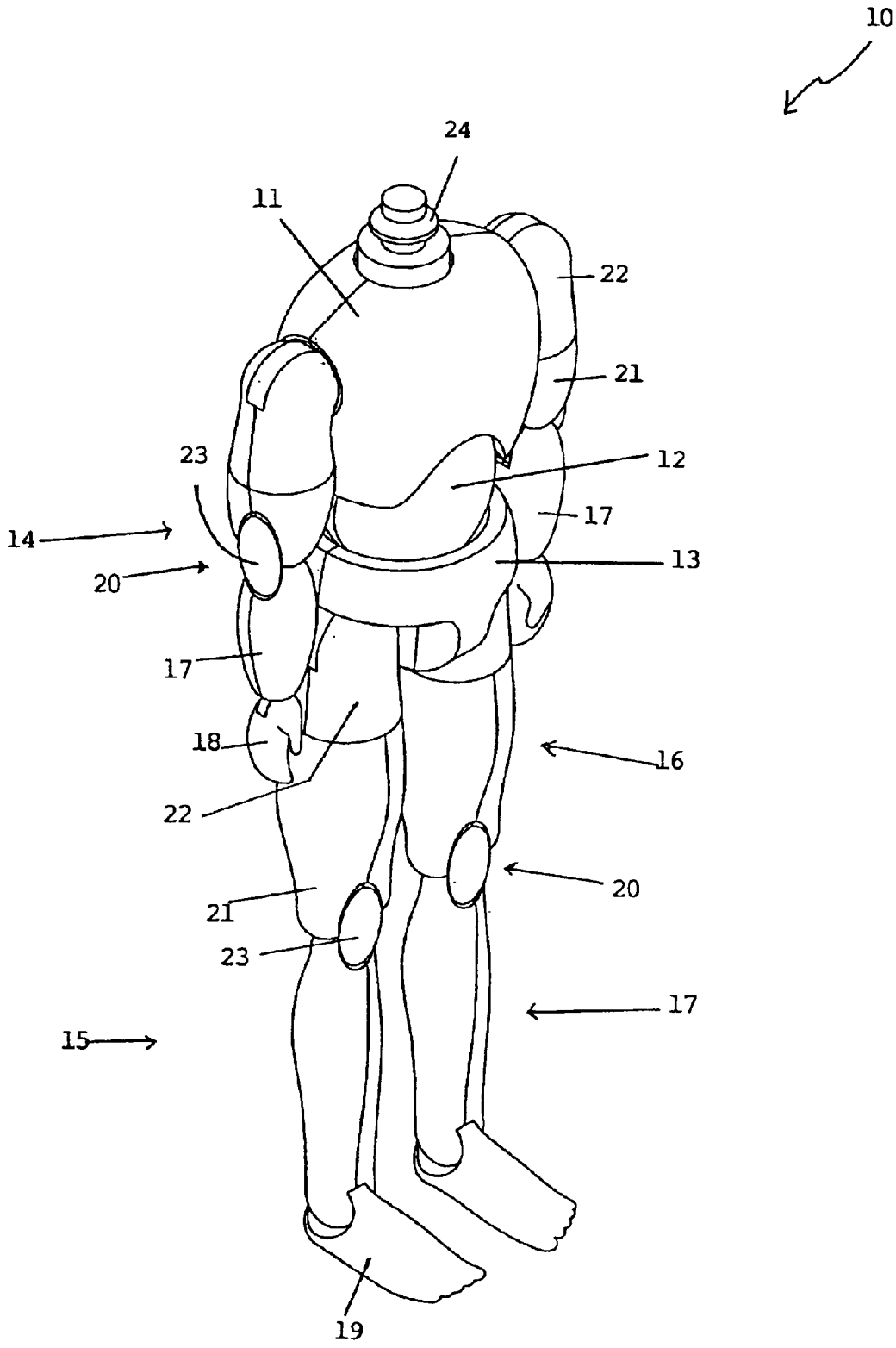
FIG. 1 is a schematic perspective illustration of the major components of an action figure.

In the accompanying drawings there is depicted schematically an action figure body 10 in human-like form.

The body 10 is made entirely of moulded plastics material, however it might alternatively be metallic or otherwise fabricated.

The body 10 comprises a chest 11, a midsection 12, hips 13, arms 14, legs 15, hands 18 and feet 19.

Each arm has a proximal arm segment made up of upper portion 22 and a lower portion 21 that can twist with respect to the upper portion 22 in a manner to be described later. There is also a distal or forearm segment 17 attached to the upper arm segment by an elbow joint 20.

Similarly, each leg comprises a proximal limb segment 16 and a distal limb segment 17 connected to one another by a knee joint 20. The proximal or thigh limb segment 16 comprises an upper thigh portion 22 and a lower thigh portion 21 that can twist with respect to the upper portion 22 in a manner to be described later.

There is a neck 24 attached to the chest 11 and of course a head (not shown) would be attached pivotally to the neck.

Figure 8:
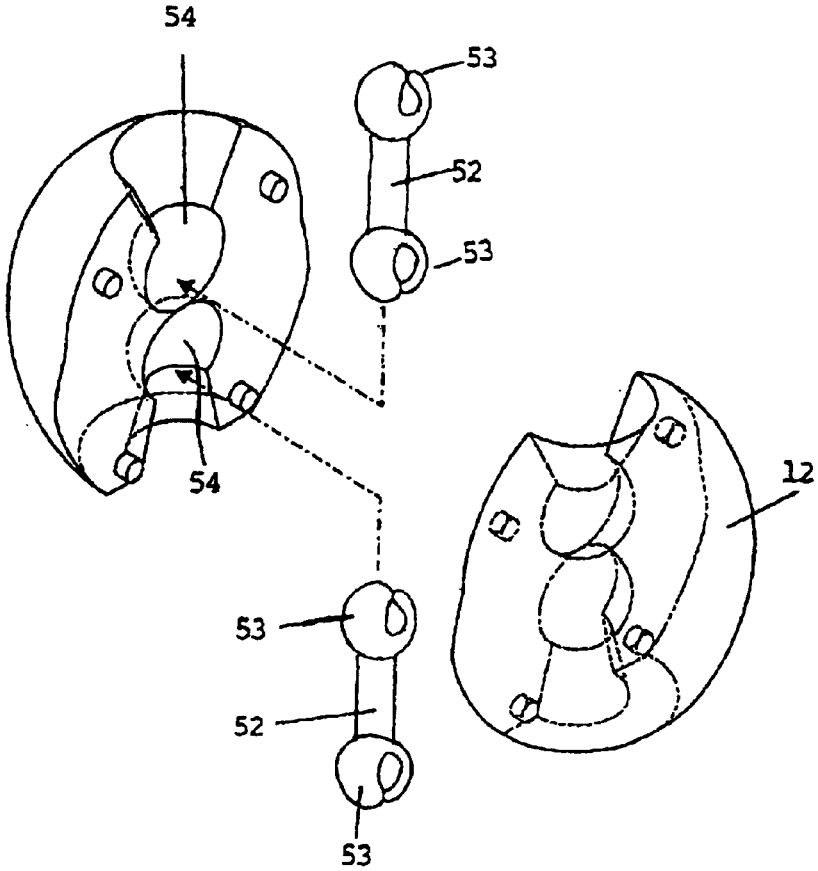
FIG. 8 is a schematic parts-exploded perspective illustration of the midsection of the action figure of FIGS. 1 and 2.

The chest 11, midsection 12 and its 13 are articulated by means of ball and socket joins to be described later with reference to FIGS. 8 and 9.

Figure 2:
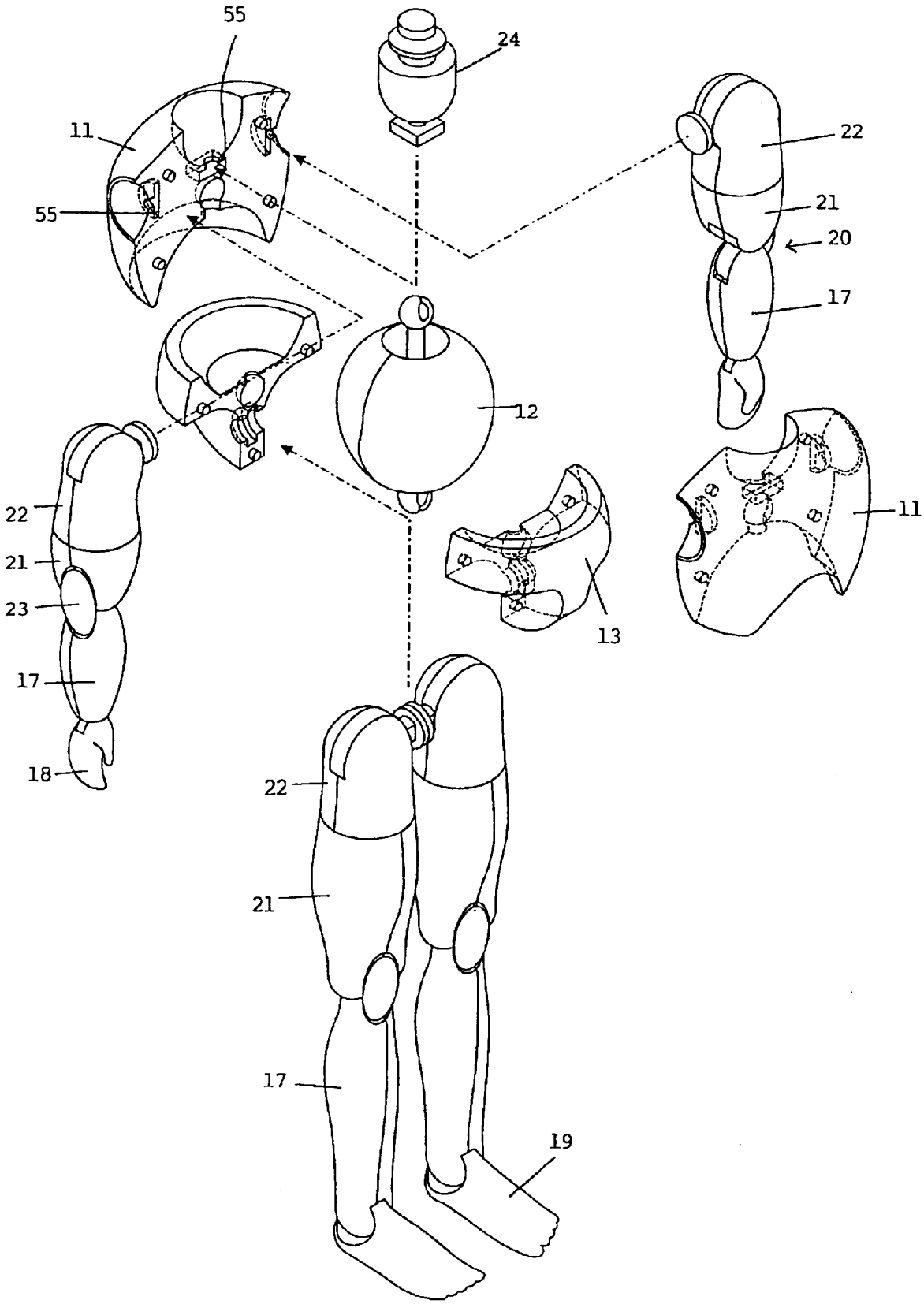
FIG. 2 is a schematic parts-exploded perspective illustration of the action figure of FIG. 1.
Figure 3:
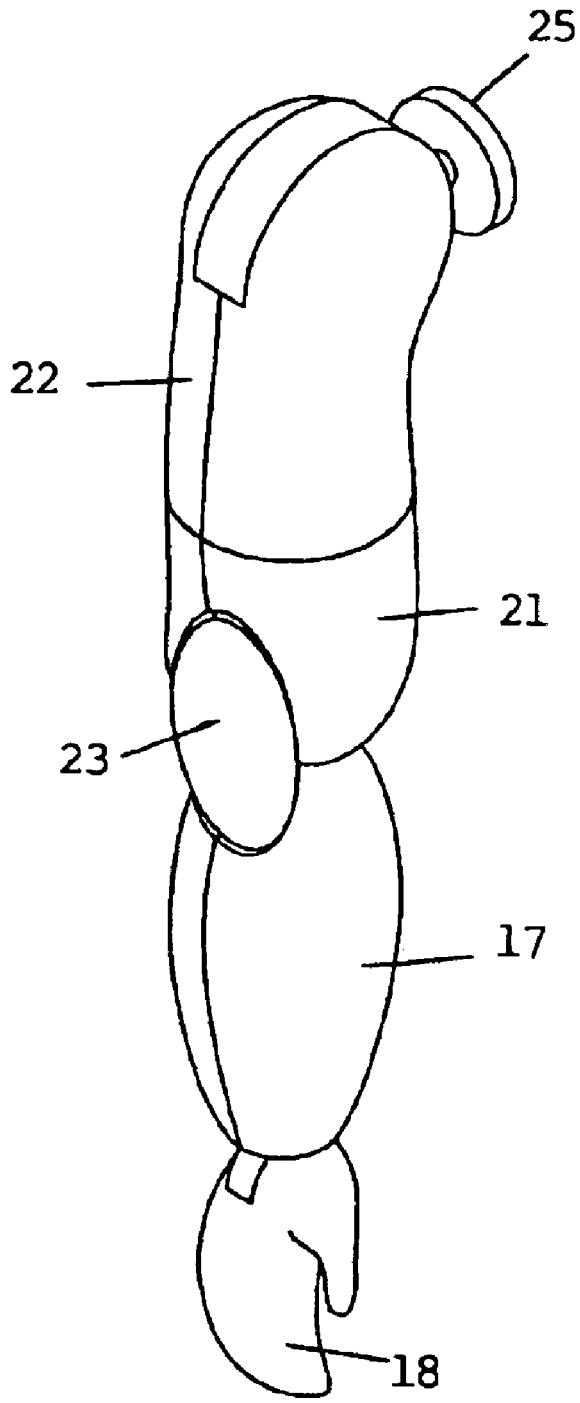
FIG. 3 is a schematic perspective illustration of one of the arms of the action figure of FIGS. 1 and 2.

Each arm will now be described with reference to FIGS. 3, 4 and 5. The upper arm portions 21 and 22 each comprise halves that are snapped, screwed, glued, ultrasonic plastic wedding or otherwise fixed together. There is a circular cavity 30 just beneath the interface of the two portions 21 and 22 with which a portion-connecting disc 29 interacts to allow twisting movement of the lower portion 21 with respect to the upper portion 22. At the shoulder area of the upper portion 22, there is a pin 27 that passes through a hole 28 in a shoulder disc 26. The shoulder disc has extending from it a shoulder pivot disc 25 to be received by a circular cavity 55 (FIG. 2) in the chest 11. That is, the shoulder disc 26 is allowed to pivot with respect to the chest 11 and the upper portion 22 is allowed to pivot with respect to the shoulder disc 26. The respective pivot axes are at right angles to one another.

Figure 4:
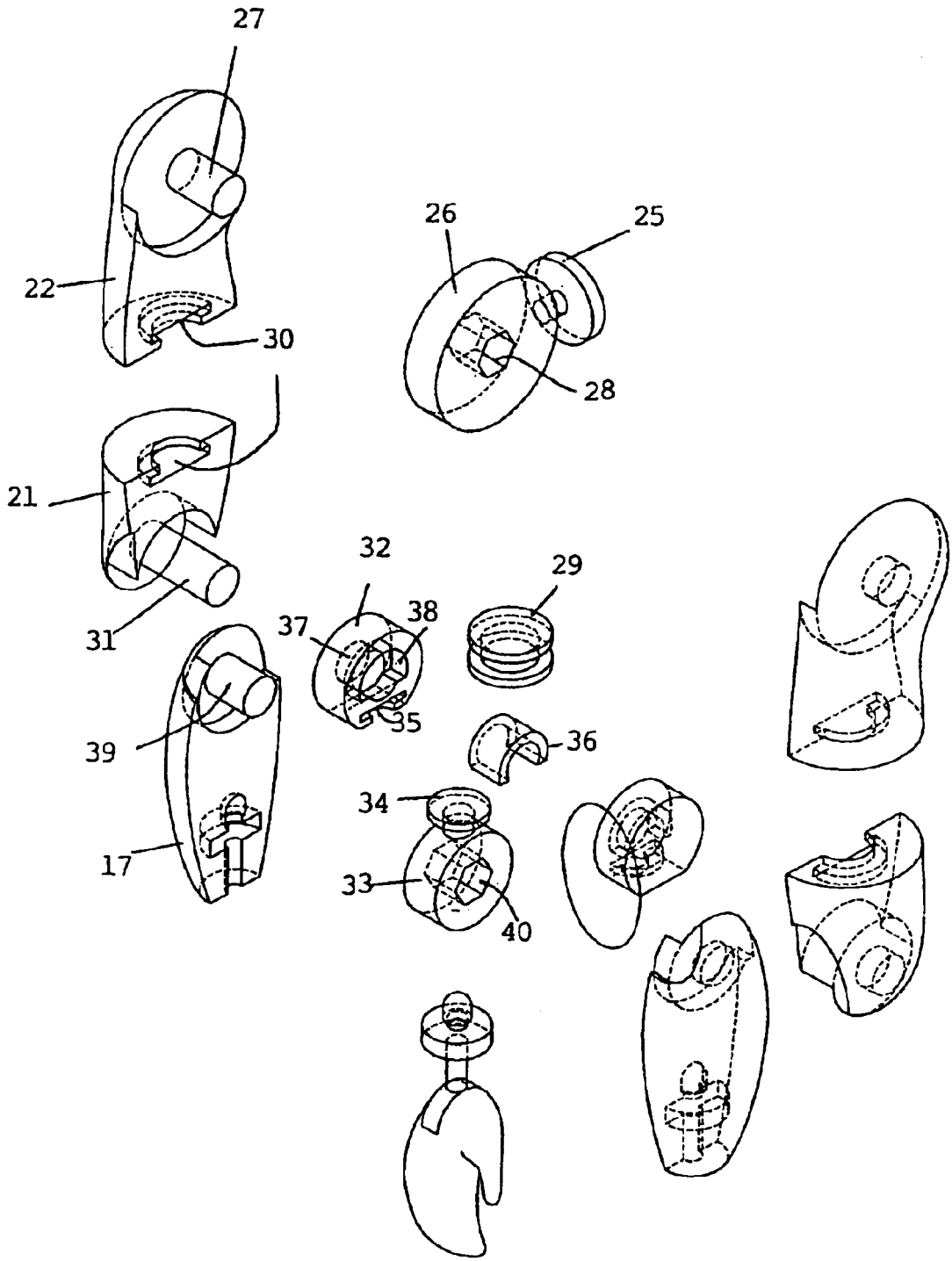
FIG. 4 is a schematic parts-exploded perspective illustration of the arm of FIG. 3.
Figure 5:
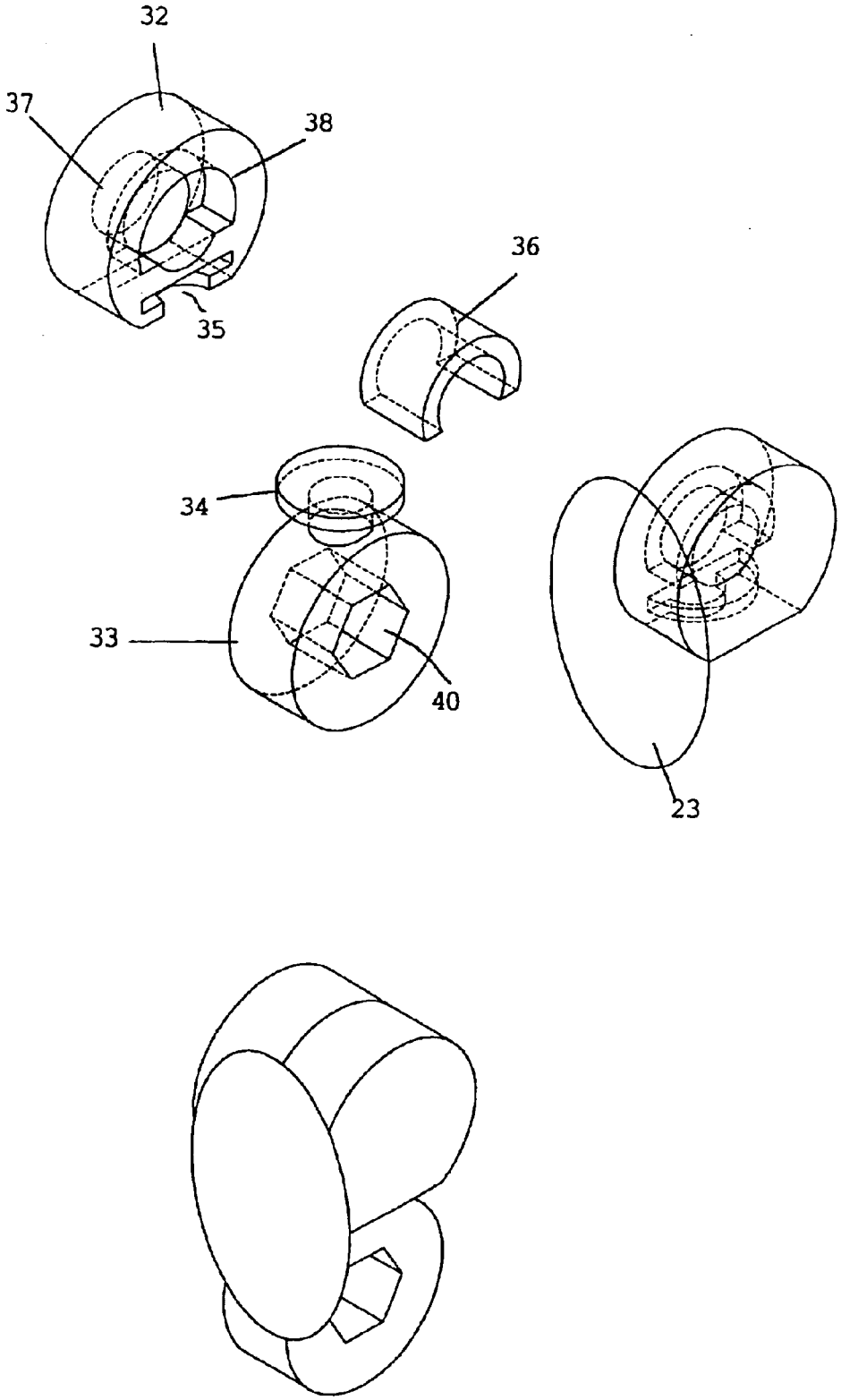
FIG. 5 is a schematic parts-exploded perspective illustration of the elbow joint of the arm of FIGS. 3 and 4.
Figure 6:
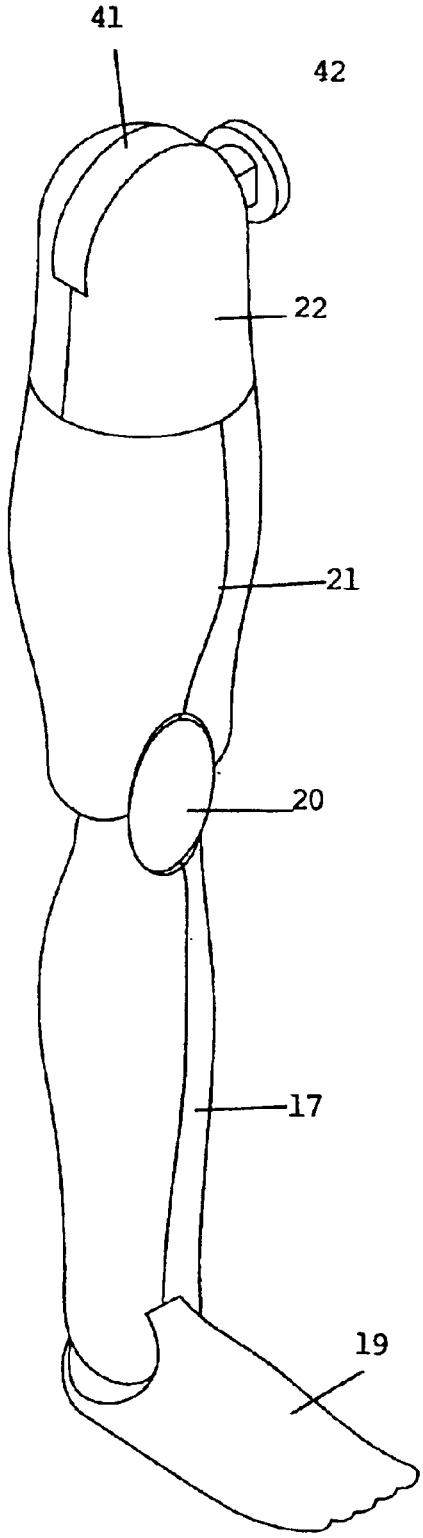
FIG. 6 is a schematic perspective illustration of one of the legs of the action figure of FIGS. 1 and 2.

Referring now to FIGS. 4 and 5 in combination, the elbow joint configuration is described. This applies equally to the knee joint to be described briefly later. At the bottom of the lower portion 21 is a transversely extending pin 31. Received by this pin 31 is a first intermediate member 32 that is substantially annular in form. The first intermediate member 32 has a throughhole 37 to receive the pin 31. An arch 36 fits within an arch-shaped recess 38 about the pin 31. The first intermediate member 32 can therefore pivot about the pin 31. The first intermediate member 32 has a cavity 35 just above its bottom surface to receive a connection disc 34 extending from a second intermediate member 33. As an alternative, the first intermediate member the 32 might have a disc 34 extending downwardly to be received within a cavity 35 just below the top surface of the second intermediate member 33. Either way, the second intermediate member can twist with respect to the first intermediate member. There is an aperture 40 extending through the second intermediate member through which a pin 39 of the forearm or distal limb segment 17 extends. That is, the distal limb segment 17 can pivot about pin 39 and also twist by virtue of the interaction between the first and second intermediate members. The described elbow joint configuration enables a 3D movement of the forearm with respect to the upper arm throughout 360 degrees and more.

The hand 18 can twist upon the distal limb segment 17 by means shown in FIG. 4.

There is a cap 23 somewhat like a kneecap attached to the first intermediate member 32. The cap can engage with an upper part of the forearm segment 17 to prevent over-swinging thereof.

The above-described configuration allows manipulation of the arm to provide human-like movements.

Figure 7:
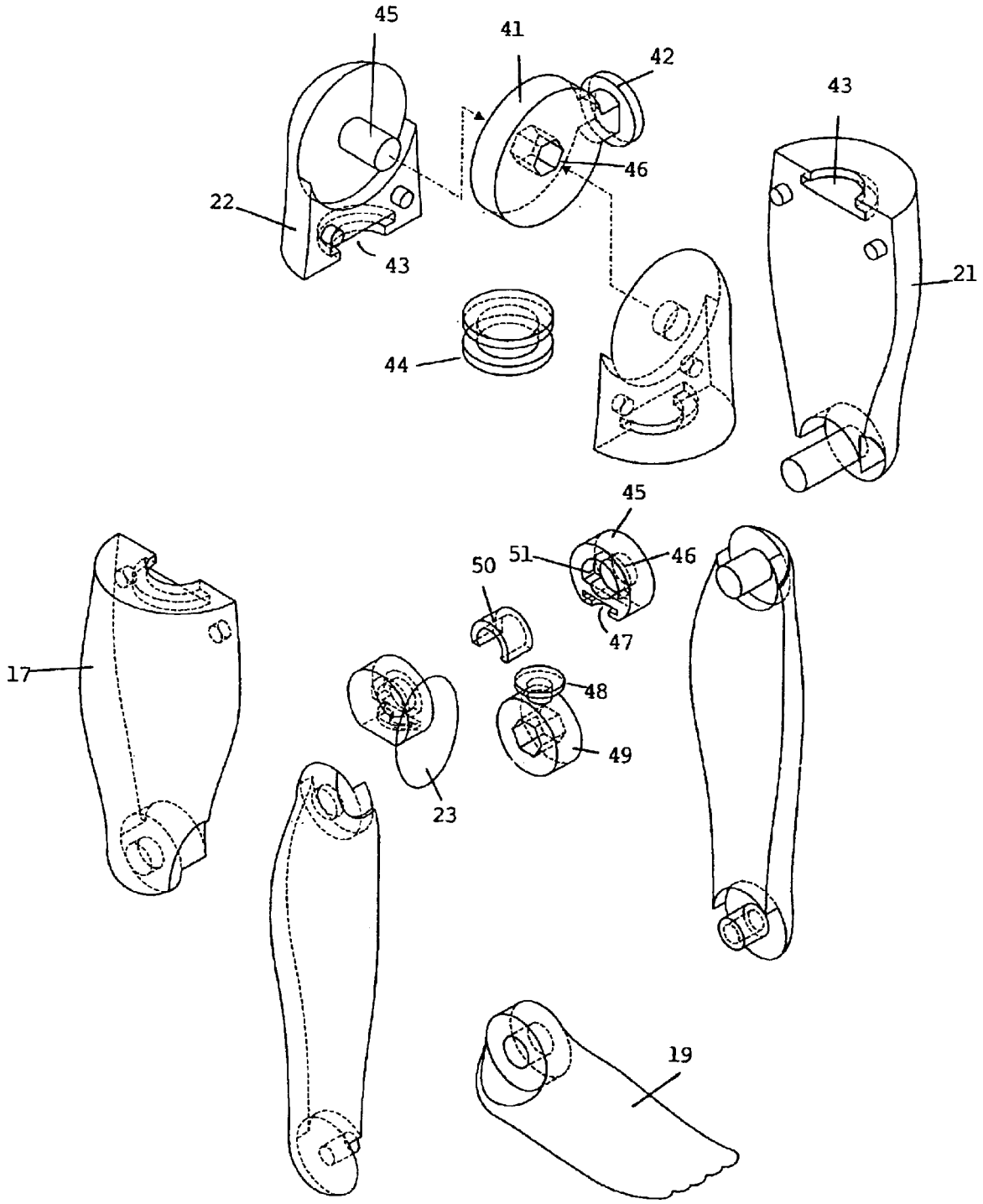
FIG. 7 is a schematic parts-exploded perspective illustration of the leg of FIG. 6.

The legs are connected to the hip 13 by hip discs 41 attached to the hip 13 in a manner similar to that by which the upper arm portion 22 is attached to the chest 11. The thigh comprises an upper thigh portion 22 connected to a lower thigh portion 21 in a manner the same as that by which the proximal arm upper and lower portions are connected. There are parts 45 to 50 that function in the same way as the elbow joint 20 providing a knee joint as shown in FIG. 7. These parts will not be described to avoid repetition. Needless to say, the kneecap 23 prevents over-swinging of the distal limb segment 17. Furthermore, the knee joint configuration is adapted to enable a 3D movement of the lower leg with respect to the thigh throughout 360 degrees and more.

The foot 19 is attached pivotally to the remote end of distal limb segment 17 by means illustrated.

Figure 9:
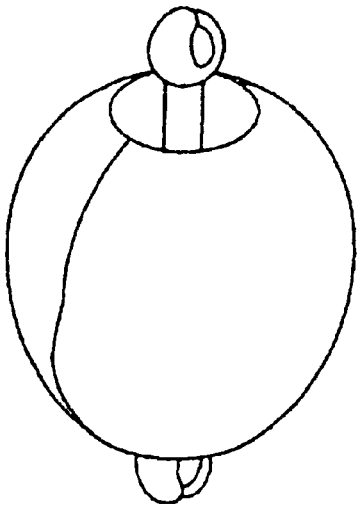
FIG. 9 is a schematic perspective illustration of the assembled midsection of FIG. 8, FIG. 10 and is a schematic parts-exploded perspective illustration of the neck of the action figure of FIGS. 1 and 2.
Figure 10:
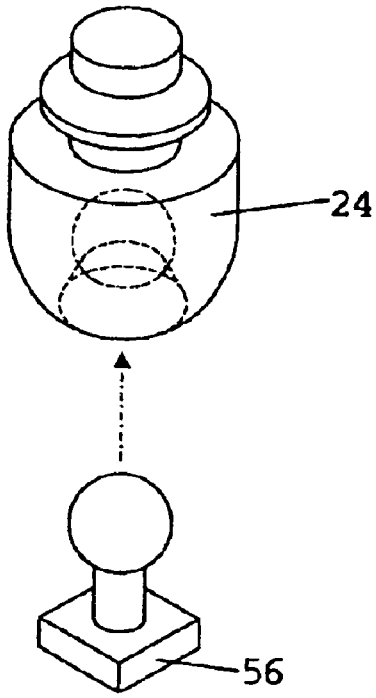
Figure 11:
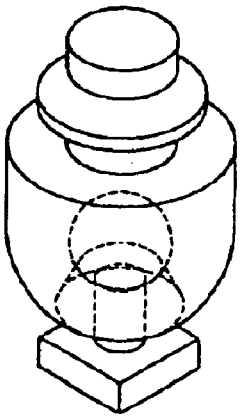
FIG. 11 is a schematic illustration of the assembled neck of FIG. 10.

Referring to now to FIG. 9, the midsection 12 comprises sockets 54 each receiving balls 53 from which a rod 52 extents. At the remote end of each rod 52 there is another ball 53 by which the midsection 12 is articulated to the chest 11 and hips 13. This articulation provides twisting as well as pivoting of the respective body components.

It should be appreciated that modifications and alterations obvious to those skilled in the art are not to be considered as beyond the scope of the present invention. For example, instead of providing disc-in-cavity articulation, ball in socket articulation could be provided for the intermediate connections.

What is claimed is:

1. An action figure comprising proximal and distal limb segments articulated to one another by a joint comprising two intermediate pivotally interconnected members, the first of which is attached pivotally to the proximal limb segment and the second of which is attached pivotally to the distal limb segment and wherein one of the first or second intermediate members comprises a disc and the other of the first or second intermediate members comprises a transverse cavity receiving the disc pivotally so that the distal limb member can twist relative to the proximal limb member.

2. The action figure of claim 1 wherein the joint is attached to the proximal limb segment so as to pivot about a first transverse axis.

3. The action figure of claim 1, wherein the body comprises a chest portion and a hip portion articulated to the chest portion by a midsection.

4. An action figure comprising proximal and distal limb segments articulated to one another by a joint comprising two intermediate pivotally interconnected members, the first of which is attached pivotally to the proximal limb segment and the second of which is attached pivotally to the distal limb segment, and wherein the proximal limb segment comprises a lower portion that can twist with respect to an upper portion.

5. An action figure comprising proximal and distal limb segments articulated to one another by a joint comprising two intermediate pivotally interconnected members the first of which is attached pivotally to the proximal limb segment and the second of which is attached pivotally to the distal limb segment, and wherein one of the intermediate members has extending therefrom a cap to engage with the distal limb segment to prevent over-swinging thereof.

6. An action figure comprising proximal and distal limb segments articulated to one another by a joint comprising two intermediate pivotally interconnected members, the first of which is attached pivotally to the proximal limb segment and the second of which is attached pivotally to the distal limb segment, and wherein the joint is attached to the proximal limb segment so as to pivot about a first transverse axis, and where the joint is attached to the distal limb segment such that the distal limb segment pivots about a second transverse axis.

7. The action figure of claim 6 wherein the two intermediate members are mutually interconnected in such a manner as to allow the second transverse axis to twist with respect to the first transverse axis.

8. An action figure comprising proximal and distal limb segments articulated to one another by a joint comprising two intermediate pivotally interconnected members, the first of which is attached pivotally to the proximal limb segment and the second of which is attached pivotally to the distal limb segment and wherein the body comprises a chest portion and a hip portion articulated to the chest portion by a midsection wherein the midsection can twist with respect to the chest portion and hip portion.

9. An action figure comprising proximal and distal limb segments articulated to one another by a joint comprising two intermediate pivotally interconnected members, the first of which is attached pivotally to the proximal limb segment and the second of which is attached pivotally to the distal limb segment and wherein the proximal limb segment is attached to the body by a joint allowing both pivoting and twisting thereof.

* * * * *